US010273103B2

(12) United States Patent
Mashimo et al.

(10) Patent No.: US 10,273,103 B2
(45) Date of Patent: Apr. 30, 2019

(54) SHEET CONVEYANCE DEVICE CAPABLE OF DETECTING SHAPE OF SHEET, IMAGE FORMING APPARATUS, SHEET SHAPE DETECTING METHOD

(71) Applicant: KYOCERA Document Solutions Inc., Osaka-shi, Osaka (JP)

(72) Inventors: Takayuki Mashimo, Osaka (JP); Toshiaki Mutsuo, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/981,583

(22) Filed: May 16, 2018

(65) Prior Publication Data

US 2018/0334345 A1 Nov. 22, 2018

(30) Foreign Application Priority Data

May 22, 2017 (JP) ..... 2017-100507

(51) Int. Cl.

| | |
|---|---|
| ***B41J 2/165*** | (2006.01) |
| ***B65H 9/00*** | (2006.01) |
| ***B65H 7/14*** | (2006.01) |
| ***B41J 13/00*** | (2006.01) |
| ***B41J 11/00*** | (2006.01) |

(Continued)

(52) U.S. Cl.

CPC ..... *B65H 9/002* (2013.01); *B41J 11/008* (2013.01); *B41J 11/0095* (2013.01); *B41J 13/0009* (2013.01); *B65H 7/14* (2013.01); *B65H 7/20* (2013.01); *G03G 15/5029* (2013.01); *B65H 3/32* (2013.01); *B65H 5/062* (2013.01); *B65H 2404/14* (2013.01); *B65H 2408/10* (2013.01); *B65H 2511/10* (2013.01); *B65H 2513/10* (2013.01); *B65H 2513/50* (2013.01); *B65H 2553/40* (2013.01); *B65H 2557/10* (2013.01); *B65H 2601/26* (2013.01); *B65H 2801/15* (2013.01); *G03G 15/6529* (2013.01); *G03G 2215/00746* (2013.01)

(58) Field of Classification Search

USPC ..... 347/16, 19, 35

See application file for complete search history.

(56) References Cited

U.S. PATENT DOCUMENTS

| | | | | |
|---|---|---|---|---|
| 8,382,241 | B2 * | 2/2013 | Saitoh | B41J 2/16526 347/16 |
| 8,864,271 | B2 * | 10/2014 | Abe | B41J 11/00 347/16 |
| 2007/0236528 | A1 * | 10/2007 | Oike | B41J 3/543 347/19 |

FOREIGN PATENT DOCUMENTS

JP 2012111152 A 6/2012

* cited by examiner

*Primary Examiner* — Lam S Nguyen

(74) *Attorney, Agent, or Firm* — Alleman Hall Creasman & Tuttle LLP

(57) ABSTRACT

A sheet conveyance device includes a shape detecting portion, and a switch control portion. The shape detecting portion detects a shape of a sheet at a detection position between a first conveyance member and a second conveyance member. The switch control portion, when a front end of the sheet has passed a arrangement position at which the first conveyance member is arranged, switches an detection interval at which the shape of the sheet is detected by the shape detecting portion, to a first interval that corresponds to a rotation speed of the first conveyance member, and when a rear end of the sheet has passed the arrangement position, switches the detection interval to a second interval that corresponds to the rotation speed of the second conveyance member.

11 Claims, 4 Drawing Sheets

(51) Int. Cl.

| | |
|---|---|
| ***B65H 7/20*** | (2006.01) |
| ***G03G 15/00*** | (2006.01) |
| *B65H 5/06* | (2006.01) |
| *B65H 3/32* | (2006.01) |

SHEET CONVEYANCE DEVICE CAPABLE OF DETECTING SHAPE OF SHEET, IMAGE FORMING APPARATUS, SHEET SHAPE DETECTING METHOD

INCORPORATION BY REFERENCE

This application is based upon and claims the benefit of priority from the corresponding Japanese Patent Application No. 2017-100507 filed on May 22, 2017, the entire contents of which are incorporated herein by reference.

BACKGROUND

The present disclosure relates to a sheet conveyance device, an image forming apparatus including a sheet conveyance device, and a sheet shape detecting method executed on a sheet conveyance device.

An image forming apparatus such as a printer includes a registration roller. Each time a predetermined conveyance timing comes, the registration roller feeds a sheet toward a conveyance belt that conveys the sheet at an image forming position where an image is formed by an image forming portion.

In addition, there is known a configuration that includes a shape detecting portion configured to detect a shape of a sheet at a position immediately before the image forming position in a sheet conveyance path, in order to prevent developer such as ink from adhering to the conveyance belt at the image forming position. For example, there is known a configuration that includes a shape detecting portion including an image sensor disposed immediately before the image forming position in the conveyance path.

SUMMARY

A sheet conveyance device according to an aspect of the present disclosure includes a first conveyance member, a second conveyance member, a shape detecting portion, a first speed detecting portion, a second speed detecting portion, a determination processing portion, and a switch control portion. The first conveyance member is provided on an upstream side of an image forming position in a conveyance path along which a sheet is conveyed. The first conveyance member is rotationally driven in a driving cycle in which the first conveyance member enters a driven state where the first conveyance member is driven while decelerated in a stepped manner, and then the first conveyance member is decelerated to a stopped state. The second conveyance member conveys the sheet at the image forming position by being rotationally driven to rotate at a specific speed that is a lowest speed in the driven state. The shape detecting portion includes a light emitting portion and a light receiving portion. The light emitting portion emits light toward a detection position located between the first conveyance member and the second conveyance member in the conveyance path, the light extending in a width direction of the sheet perpendicular to the conveyance path. The light receiving portion receives the light that has been emitted from the light emitting portion and reflected on the sheet passing the detection position, and outputs a detection signal corresponding to an amount of received light. The shape detecting portion detects a shape of the sheet based on the detection signal. The first speed detecting portion detects a rotation speed of the first conveyance member. The second speed detecting portion detects a rotation speed of the second conveyance member. The determination processing portion determines whether or not a front end of the sheet that is being conveyed has passed an arrangement position at which the first conveyance member is arranged, and determines whether or not a rear end of the sheet that is being conveyed has passed the arrangement position. The switch control portion, when the determination processing portion determines that the front end of the sheet has passed the arrangement position, switches an output interval at which the detection signal is output from the light receiving portion, to a first interval that corresponds to the rotation speed detected by the first speed detecting portion, and when the determination processing portion determines that the rear end of the sheet has passed the arrangement position, switches the output interval to a second interval that corresponds to the rotation speed detected by the second speed detecting portion.

An image forming apparatus according to another aspect of the present disclosure includes the sheet conveyance device and an image forming portion. The image forming portion forms an image on a sheet at the image forming position.

A sheet shape detecting method according to a further aspect of the present disclosure is executed on a sheet conveyance device which includes a first conveyance member, a second conveyance member, a shape detecting portion, a first speed detecting portion, and a second speed detecting portion, the first conveyance member being provided on an upstream side of an image forming position in a conveyance path along which a sheet is conveyed, the first conveyance member being rotationally driven in a driving cycle in which the first conveyance member enters a driven state where the first conveyance member is driven while decelerated in a stepped manner, and then the first conveyance member is decelerated to a stopped state, the second conveyance member being configured to convey the sheet at the image forming position by being rotationally driven to rotate at a specific speed that is a lowest speed in the driven state, the shape detecting portion including a light emitting portion and a light receiving portion, the light emitting portion being configured to emit light toward a detection position located between the first conveyance member and the second conveyance member in the conveyance path, the light extending in a width direction of the sheet perpendicular to the conveyance path, the light receiving portion being configured to receive the light that has been emitted from the light emitting portion and reflected on the sheet passing the detection position, and output a detection signal corresponding to an amount of received light, the shape detecting portion being configured to detect a shape of the sheet based on the detection signal, the first speed detecting portion being configured to detect a rotation speed of the first conveyance member, the second speed detecting portion being configured to detect a rotation speed of the second conveyance member. The sheet shape detecting method includes: determining whether or not a front end of the sheet that is being conveyed has passed an arrangement position at which the first conveyance member is arranged, and determining whether or not a rear end of the sheet that is being conveyed has passed the arrangement position; and when it is determined that the front end of the sheet has passed the arrangement position, switching an output interval at which the detection signal is output from the light receiving portion, to a first interval that corresponds to the rotation speed detected by the first speed detecting portion, and when it is determined that the rear end of the sheet has passed the arrangement position, switching the output interval to a second interval that corresponds to the rotation speed detected by the second speed detecting portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclusure with reference to the accompanying drawings for the understanding of the present disclosure. It should be noted that the following embodiment is an example of a specific embodiment of the present disclosure and should not limit the technical scope of the present disclosure.

[Outlined Configuration of Image Forming Apparatus 10]

Figure 1:
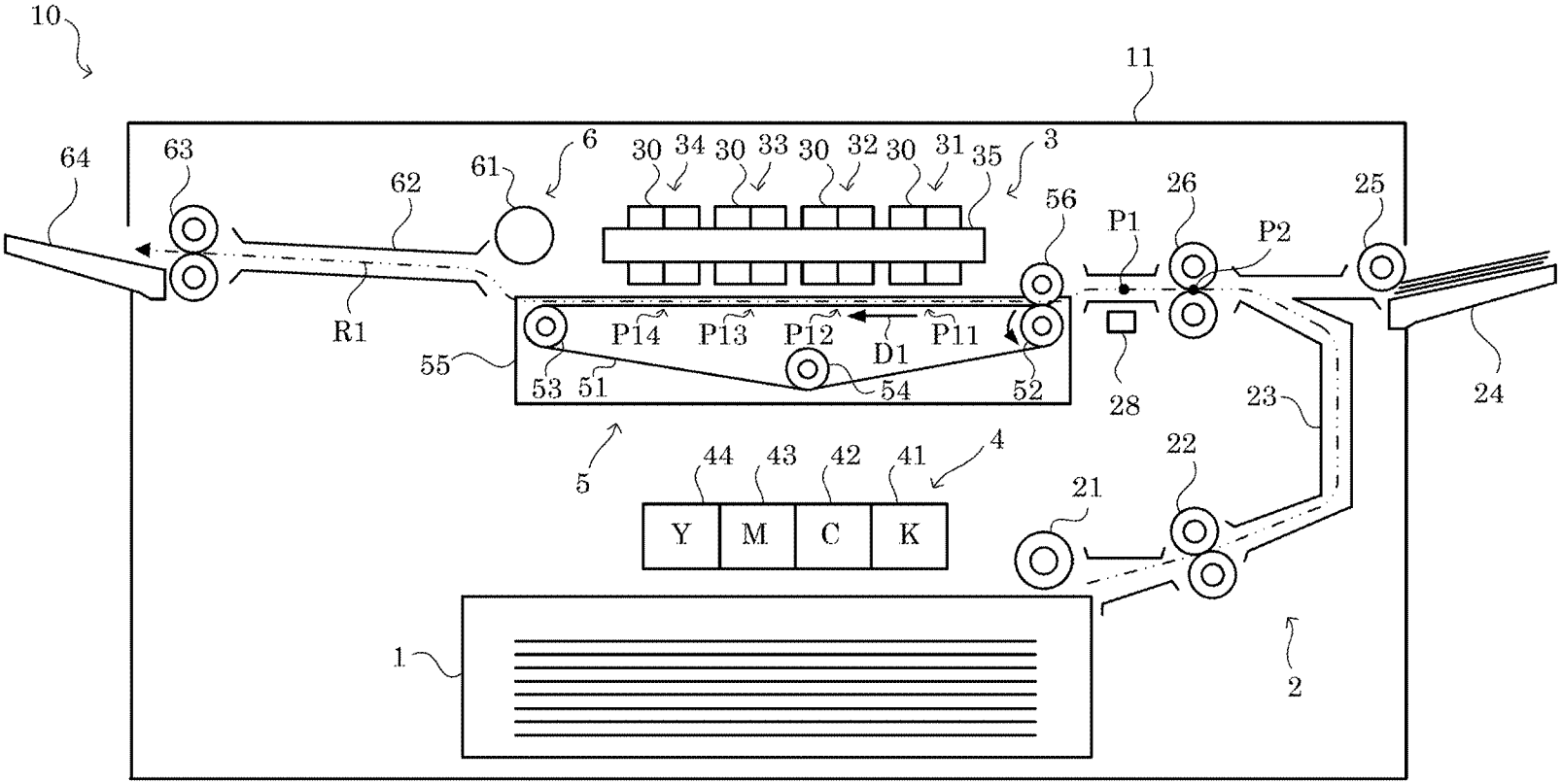
FIG. 1 is a diagram showing a configuration of an image forming apparatus according to an embodiment of the present disclosure.
Figure 2:
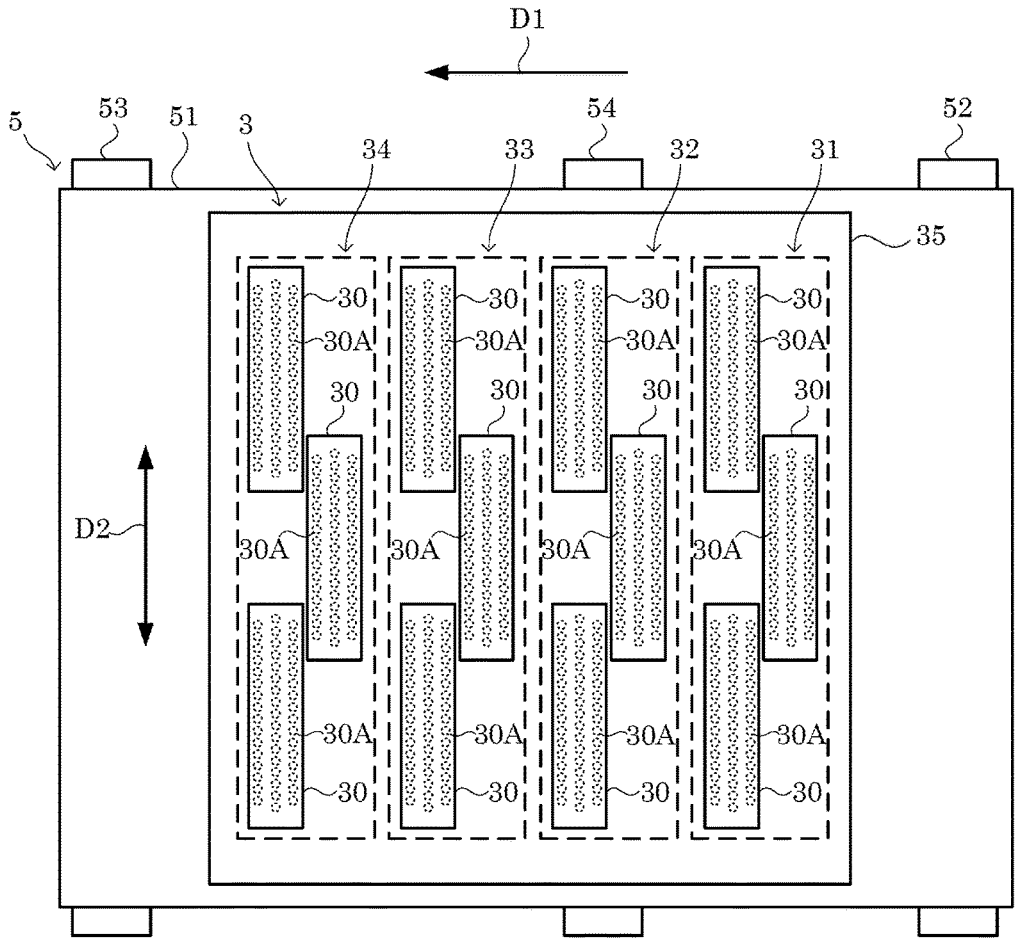
FIG. 2 is a diagram showing a configuration of an image forming portion in the image forming apparatus according to the embodiment of the present disclosure.

First, an outlined configuration of an image forming apparatus 10 according to an embodiment of the present disclosure is described with reference to FIG. 1 to FIG. 3. Here, FIG. 1 is a schematic cross-sectional diagram showing a configuration of the image forming apparatus 10. In addition, FIG. 2 is a plan diagram showing a configuration of an image forming portion 3. It is noted that in FIG. 1, a sheet conveyance path R1 in a housing 11 of the image forming apparatus 10 is indicated by a two-dot chain line. Furthermore, in FIG. 3, flows of electric signals are indicated by arrow lines.

The image forming apparatus 10 is a printer that forms an image by an inkjet system. It is noted that the present disclosure is applicable to image forming apparatuses such as a facsimile apparatus, a copier, and a multifunction peripheral that form an image by the inkjet system.

Figure 3:
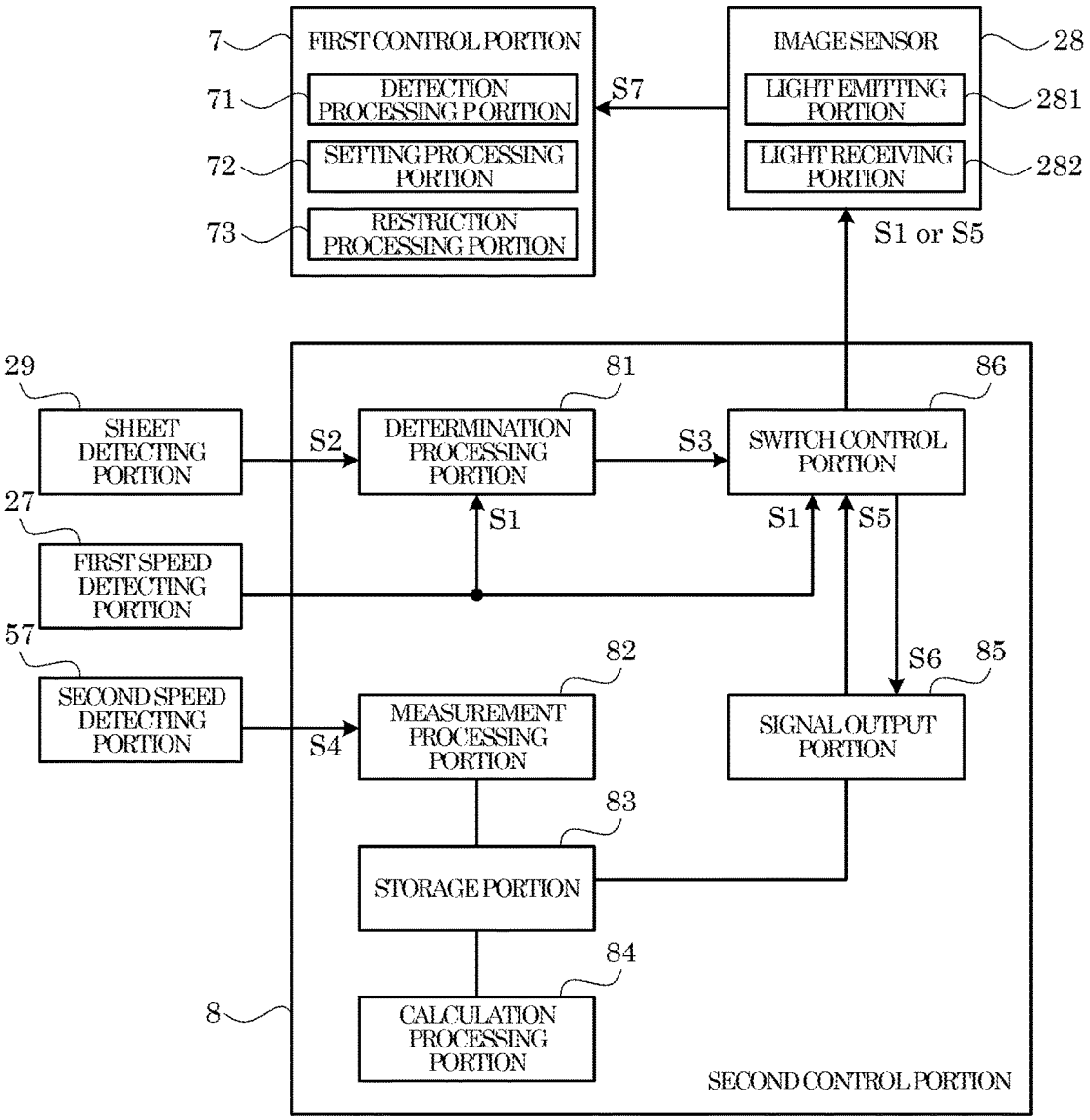
FIG. 3 is a block diagram showing a configuration of a first control portion and a second control portion in the image forming apparatus according to the embodiment of the present disclosure.

As shown in FIGS. 1 and 3, the image forming apparatus 10 includes a sheet feed cassette 1, a sheet feed portion 2, the image forming portion 3, an ink container portion 4, a conveyance unit 5, a sheet discharge portion 6, a first control portion 7, and a second control portion 8. Here, a configuration including the sheet feed cassette 1, the sheet feed portion 2, the conveyance unit 5, the sheet discharge portion 6, the first control portion 7, and the second control portion 8 is an example of the sheet conveyance device of the present disclosure.

The sheet feed cassette 1 stores sheets that are print targets in the image forming apparatus 10. For example, the sheets stored in the sheet feed cassette 1 are sheet-like materials such as sheets of paper, sheets of coated paper, postcards, envelopes, and OHP sheets.

In the image forming apparatus 10, the sheets stored in the sheet feed cassette 1 are conveyed one by one in the interior of the housing 11 along the conveyance path R1 (see FIG. 1) that includes image forming positions P11 to P14 where an image is formed on each sheet by the image forming portion 3, and discharged to a sheet discharge tray 64 of the sheet discharge portion 6.

The sheet feed portion 2 supplies the sheets stored in the sheet feed cassette 1 to the conveyance unit 5 one by one. As shown in FIG. 1 and FIG. 3, the sheet feed portion 2 includes a pickup roller 21, a conveyance roller 22, a conveyance path 23, a manual feed tray 24, a sheet feed roller 25, a registration roller 26, a first speed detecting portion 27, an image sensor 28, and a sheet detecting portion 29.

The pickup roller 21 picks up the sheets one by one from the sheet feed cassette 1. The conveyance roller 22 conveys the sheet picked up by the pickup roller 21 to the registration roller 26. The conveyance path 23 is a moving passage of the sheet from the sheet feed cassette 1 and the manual feed tray 24 to the conveyance unit 5. The conveyance path 23 defines a sheet feed path from the sheet feed cassette 1 to the conveyance unit 5, among the conveyance path R1. The manual feed tray 24 and the sheet feed roller 25 are used to supply sheets from outside.

The registration roller 26 is provided on the upstream side of the image forming positions P11 to P14 in the conveyance path R1. Each time a predetermined conveyance timing comes, the registration roller 26 feeds a sheet toward the conveyance unit 5. For example, in the image forming apparatus 10, an optical sensor (not shown) for detecting presence/absence of a sheet is provided on the upstream side of the registration roller 26 in the conveyance path R1. The registration roller 26 is rotationally driven at a timing when a predetermined time period has elapsed since a detection of a front end of a sheet by the optical sensor. The registration roller 26 is decelerated at a timing when a predetermined time period has elapsed since a detection of a rear end of a sheet by the optical sensor, and decelerated until it is stopped, wherein the predetermined time period is longer than a time period that has elapsed since the detection of the rear end of the sheet by the optical sensor until the rear end of the sheet passes an arrangement position P2 (see FIG. 1) at which the registration roller 26 is arranged. The registration roller 26 is rotationally driven by a rotational driving force supplied from a first motor (not shown). Here, the registration roller 26 is an example of the first conveyance member of the present disclosure.

The first speed detecting portion 27 detects a rotation speed of the registration roller 26. For example, the first speed detecting portion 27 is a rotary encoder attached to a rotation shaft of the registration roller 26. The first speed detecting portion 27 outputs an electric signal S1 (see FIG. 3) in a cycle corresponding to a reciprocal of the rotation speed of the registration roller 26. For example, the electric signal S1 is a pulse signal. In the image forming apparatus 10, driving of the first motor is controlled by performing a feedback control based on the electric signal S1 output from the first speed detecting portion 27 such that the rotation speed of the registration roller 26 is set to a first speed V1 or a second speed V2 (see FIG. 4) that are described below. In addition, the electric signal S1 output from the first speed detecting portion 27 is input to the second control portion 8.

The image sensor 28 is used to detect the shape of the sheet conveyed along the conveyance path R1. For example, the image sensor 28 is an image sensor of a CIS system. As shown in FIG. 1, the image sensor 28 is disposed at a position between the registration roller 26 and the conveyance unit 5 in the conveyance path R1. Specifically, as shown in FIG. 3, the image sensor 28 includes a light emitting portion 281 and a light receiving portion 282.

The light emitting portion 281 emits light toward a detection position P1 (see FIG. 1) located between the registration roller 26 and the conveyance unit 5 in the conveyance path R1, wherein light beams composing the light are aligned along a width direction D2 (see FIG. 2) of the sheet perpendicular to the conveyance path R1. For example, the light emitting portion 281 is composed of a plurality of light emitting elements, such as LED diodes, arranged along the width direction D2.

The light receiving portion 282 is configured to receive light that has been emitted from the light emitting portion 281 and reflected on the sheet passing the detection position P1, and output a detection signal S7 (see FIG. 3) corresponding to an amount of the received light. For example, the light receiving portion 282 is composed of a plurality of light receiving elements, such as photodiodes, arranged along the width direction D2. The detection signal S7 output from the light receiving portion 282 is input to the first control portion 7.

The sheet detecting portion 29 detects whether or not a sheet is present at the arrangement position P2 (see FIG. 1) at which the registration roller 26 is arranged. For example, the sheet detecting portion 29 is a reflective or transmissive optical sensor including a light emitting portion and a light receiving portion. The sheet detecting portion 29 outputs an electric signal S2 (see FIG. 3) that indicates whether or not a sheet is present at the arrangement position P2. The electric signal S2 output from the sheet detecting portion 29 is input to the second control portion 8.

The image forming portion 3 forms an image based on image data on the sheet supplied from the sheet feed portion 2 by using ink that is developer. As shown in FIG. 1, the image forming portion 3 includes line heads 31, 32, 33, and 34 and a head frame 35 supporting the line heads, the line heads 31, 32, 33, and 34 respectively corresponding to colors black, cyan, magenta, and yellow. The head frame 35 is supported by the housing 11 of the image forming apparatus 10. It is noted that the number of the line heads included in the image forming portion 3 may be 1 (one), or 2 (two) or more excluding 4 (four).

The line heads 31 to 34 are so-called line-head-type recording heads. That is, the image forming apparatus 10 is a so-called line-head-type image forming apparatus. As shown in FIG. 2, the line heads 31 to 34 are elongated in the width direction D2. Specifically, each of the line heads 31 to 34 has a length that corresponds to the width of a sheet of the maximum size among sheets that can be stored in the sheet feed cassette 1. The line heads 31 to 34 are fixed to the head frame 35 at regular intervals along a sheet conveyance direction D1 (see FIG. 2). Positions in the conveyance path R1 respectively facing the line heads 31 to 34 are the image forming positions P11 to P14 in the image forming portion 3.

As shown in FIG. 2, each of the line heads 31 to 34 includes a plurality of recording heads 30. The recording heads 30 eject ink toward a sheet conveyed by the conveyance unit 5. Specifically, a lot of nozzles 30A (see FIG. 2) for ejecting ink are provided on a facing surface of each of the recording heads 30, each of the nozzles 30A having an opening, the facing surface facing the sheet conveyed by the conveyance unit 5. In addition, each of the recording heads 30 includes pressurizing chambers (not shown), piezoelectric elements (not shown), and communication flow passages (not shown), the pressurizing chambers respectively corresponding to the nozzles 30A, the piezoelectric elements 302 respectively corresponding to the pressurizing chambers, the communication flow passages being respectively communicated with the pressurizing chambers. Upon application of a predetermined driving voltage, each of the piezoelectric elements causes ink to be ejected from the nozzle 30A. Specifically, each of the piezoelectric elements pressurizes ink stored in the pressurizing chamber so that the ink is ejected from the nozzle 30A.

In the present embodiment, in the line head 31, three recording heads 30 are arranged in zigzag along the width direction D2. In addition, in each of the other line heads 32 to 34, as in the line head 31, three recording heads 30 are arranged in zigzag along the width direction D2. It is noted that FIG. 2 shows a state where the recording portion 3 is viewed from the upper side of FIG. 1.

The ink container portion 4 includes ink containers 41, 42, 43, and 44 that respectively store black, cyan, magenta, and yellow ink. The ink containers 41 to 44 are connected to the line heads 31 to 34 of the corresponding colors, via ink supply portions (not shown), respectively.

The conveyance unit 5 conveys the sheet on the image forming positions P11 to P14 in the conveyance path R1. Specifically, as shown in FIG. 1, the conveyance unit 5 is disposed below the line heads 31 to 34. The conveyance unit 5 conveys the sheet in a state of facing the recording heads 30. As shown in FIG. 1, the conveyance unit 5 includes a conveyance belt 51 on which the sheet is placed, stretching rollers 52 to 54, and a conveyance frame 55, the sheet conveying belt 51 being stretched over the stretching rollers 52 to 54, the conveyance frame 55 supporting these members. It is noted that the interval between the conveyance belt 51 and the recording heads 30 is adjusted so that during an image forming, the interval between the sheet surface and the recording heads 30 is, for example, 1 (one) mm.

The stretching roller 52 is rotationally driven to rotate at a predetermined second speed V2 (see FIG. 4) by a rotational driving force supplied from a second motor (not shown), wherein the second speed V2 is the lowest speed in a driven state where the registration roller 26 is driven, as described below. This causes the conveyance belt 51 to move, at the second speed V2, in a direction in which the sheet is conveyed in the sheet conveyance direction D1 (see FIG. 1). As a result, the sheet supplied from the sheet feed portion 2 is conveyed by the moving conveyance belt 51 to the sheet discharge portion 6 via the image forming positions P11 to P14 (see FIG. 1). Here, the conveyance belt 51 is an example of the second conveyance member of the present disclosure. In addition, the second speed V2 is an example of the specific speed of the present disclosure.

It is noted that the conveyance unit 5 also includes a suction unit (not shown) for sucking air through a lot of through holes formed in the conveyance belt 51 so that the sheet is attracted by the conveyance belt 51. In addition, a pressure roller 56 is provided at a position facing the stretching roller 52 so that the sheet is conveyed while being pressed against the conveyance belt 51.

As shown in FIG. 3, the conveyance unit 5 includes a second speed detecting portion 57. The second speed detecting portion 57 detects a rotation speed of the conveyance belt 51. For example, the second speed detecting portion 57 is a rotary encoder attached to a rotation shaft of the stretching roller 52. The second speed detecting portion 57 outputs an electric signal S4 (see FIG. 3) in a cycle corresponding to a reciprocal of the rotation speed of the stretching roller 52. For example, the electric signal S4 is a pulse signal. In the image forming apparatus 10, the driving of the second motor is controlled by a feedback control based on the electric signal S4 output from the second speed detecting portion 57, thereby the rotation speed of the conveyance belt 51 is controlled to the second speed V2 (see FIG. 4). In addition, the electric signal S4 output from the second speed detecting portion 57 is input to the second control portion 8.

The sheet discharge portion 6 is provided on the downstream side of the image forming portion 3 in the conveyance direction D1. As shown in FIG. 1, the sheet discharge portion 6 includes a drying device 61, a conveyance path 62, a sheet discharge roller 63, and a sheet discharge tray 64. The drying device 61 dries the ink that has adhered to the sheet, by, for example, blowing air to the sheet. The conveyance path 62 is a moving passage of the sheet from the conveyance unit 5 to the sheet discharge tray 64. The conveyance path 62 defines a sheet discharge path from the conveyance unit 5 to the sheet discharge tray 64, the sheet discharge path being a section of the conveyance path R1. The sheet discharge roller 63 discharges the sheet to the sheet discharge tray 64.

The first control portion 7 comprehensively controls the image forming apparatus 10. Specifically, the first control portion 7 includes control equipment such as CPU, ROM, and RAM that are not shown. The CPU is a processor that executes various calculation processes. The ROM is a non-volatile storage device in which various information such as control programs for causing the CPU to execute various processes are stored in advance. The RAM is a volatile storage device that is used as a temporary storage memory (working area) for the various processes executed by the CPU. In the first control portion 7, the CPU executes the various control programs stored in advance in the ROM. This allows the image forming apparatus 10 to be controlled comprehensively by the first control portion 7. It is noted that the first control portion 7 may be constituted from an electronic circuit such as an integrated circuit (ASIC), and may be a control portion provided independently of a main control portion that comprehensively controls the image forming apparatus 10.

In addition, as shown in FIG. 3, the first control portion 7 includes a detection processing portion 71, a setting processing portion 72, and a restriction processing portion 73. Specifically, the first control portion 7 executes the control programs stored in the ROM by using the CPU. This allows the first control portion 7 to function as the detection processing portion 71, the setting processing portion 72, and the restriction processing portion 73.

The detection processing portion 71 detects the shape of the sheet conveyed toward the image forming portion 3 based on the detection signal S7 output from the image sensor 28. Here, the image sensor 28 and the detection processing portion 71 are an example of the shape detecting portion of the present disclosure.

For example, the detection processing portion 71 detects the shape of the sheet by using a reference value set by the setting processing portion 72. Specifically, the detection processing portion 71 determines whether or not the sheet is present at each of the positions that respectively face the light receiving elements, based on whether or not a value of an amount of received light received by each of the light receiving elements exceeds the reference value. This allows a shape of one line of the sheet to be detected, the one line extending along the width direction D2. It is noted that the detection processing portion 71 may detect the shape of the sheet by using a predetermined value instead of the reference value.

The setting processing portion 72 sets the reference value that is used by the detection processing portion 71 to detect the shape of the sheet, based on the detection signal S7 output from the light receiving portion 282 while the registration roller 26 is in a stopped state.

For example, each time the registration roller 26 changes its state from a driven state to the stopped state, the setting processing portion 72 sets the reference value based on the detection signal S7 output from the light receiving portion 282. In addition, the setting processing portion 72 sets the reference value for each of the light receiving elements. For example, the setting processing portion 72 sets, as the reference value for each of the light receiving elements, a sum of a predetermined value and an amount of light received by each of the light receiving elements included in the detection signal S7.

The restriction processing portion 73 restricts the image forming portion 3 from forming an image beyond the sheet, based on the shape of the sheet detected by the detection processing portion 71.

For example, the restriction processing portion 73 changes data corresponding to a region outside a sheet in image data input to the image forming portion 3, to data whose color components of cyan, magenta, and yellow are zero (data corresponding to white). This prevents ink ejected from the recording heads 30 from adhering to the conveyance belt 51 in a case where the sheet has become oblique with respect to the conveyance path R1, in a case where the sheet has a defect such as a punched hole, or in other cases. As a result, a cleaning mechanism for cleaning ink adhered to the conveyance belt 51 is not necessary.

It is noted that the image forming portion 3 may form an image by an electrophotographic system. In that case, the image forming apparatus 10 can prevent toner from adhering to the conveyance belt 51, the toner being the developer. Here, it is easier to clean the conveyance belt 51 when the developer that adheres to the conveyance belt 51 is toner, than when the developer is ink. As a result, the present disclosure is suitable for an image forming apparatus of the inkjet system.

Figure 4:
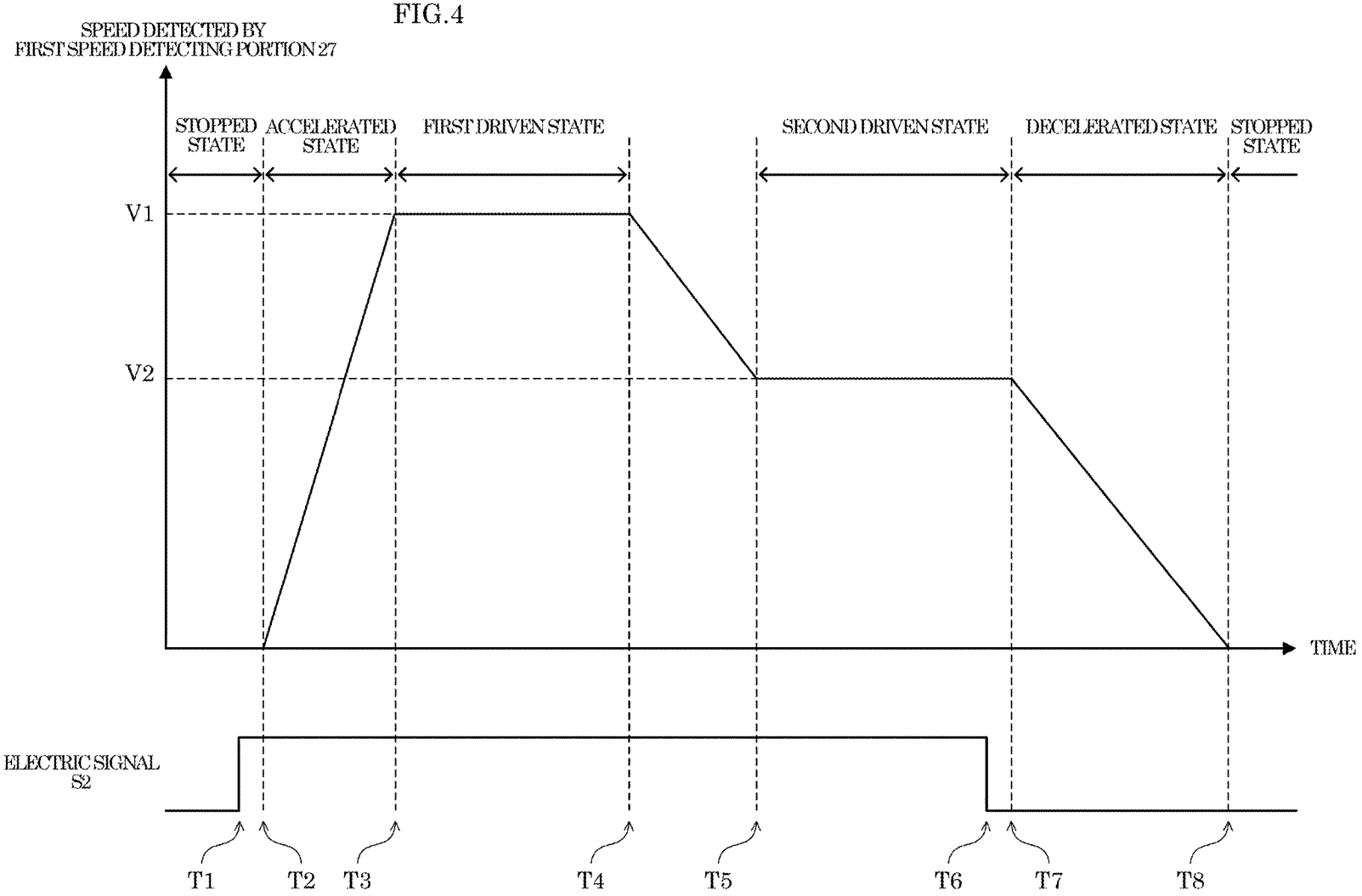
FIG. 4 is a diagram showing a driving cycle of a registration roller and an electric signal output from a sheet detecting portion in the image forming apparatus according to the embodiment of the present disclosure.

Meanwhile, as shown in FIG. 4, in the image forming apparatus 10, the registration roller 26 is rotationally driven in a driving cycle in which the registration roller 26 enters a driven state where the registration roller 26 is driven while decelerated in a stepped manner, and then the registration roller 26 is decelerated to a stopped state. Specifically, the registration roller 26 is accelerated from the stopped state to the first speed V1 that is higher than the second speed V2, and transits to a first driven state where it is driven at the first speed V1. Subsequently, the registration roller 26 is decelerated from the first driven state to the second speed V2, and transits to a second driven state where it is driven at the second speed V2. The registration roller 26 is then decelerated from the second driven state to the stopped state. This makes it possible to reduce an interval to a conveyed preceding sheet. It is noted that the number of steps of the driving speed of the registration roller 26 may be three or more.

Here, in the image forming apparatus 10, the image sensor 28 is disposed between the registration roller 26 and the conveyance belt 51. In this case, the sheet conveyance speed changes while the image sensor 28 is detecting the shape of the sheet. As a result, in a case where an output interval at which the detection signal S7 corresponding to the shape of the sheet is output from the image sensor 28 is set to a fixed interval, the positions on the sheet at which the shape of the sheet is detected by the detection processing portion 71 become irregular, and the accuracy of the sheet shape detection is reduced.

One of assumed countermeasures for the problem would be to synchronize the output interval at which the detection signal S7 is output from the image sensor 28, with the rotation speed of the registration roller 26. However, in that case, while the registration roller 26 is stopped, the detection signal S7 is not output from the image sensor 28. When this happens, until the next sheet is conveyed, the setting processing portion 72 cannot set the reference value based on the detection signal S7 output from the image sensor 28.

On the other hand, the image forming apparatus 10 according to the embodiment of the present disclosure is configured to restrict reduction in accuracy of detecting the shape of the sheet, and set, before the next sheet is conveyed, the reference value used to detect the shape of the sheet.

In the following, the second control portion 8 is described with reference to FIG. 3 and FIG. 4.

The second control portion 8 is configured to switch the output interval at which the detection signal S7 is output from the light receiving portion 282 of the image sensor 28, between a first interval corresponding to the speed detected by the first speed detecting portion 27 and a second interval corresponding to the speed detected by the second speed detecting portion 57. For example, the second control portion 8 is composed of an electronic circuit such as an integrated circuit (ASIC, DSP). It is noted that in the image forming apparatus 10, the CPU of the first control portion 7 may function as the second control portion 8 by executing the control program stored in the ROM.

Specifically, as shown in FIG. 3, the second control portion 8 includes a determination processing portion 81, a measurement processing portion 82, a storage portion 83, a calculation processing portion 84, a signal output portion 85, and a switch control portion 86.

The determination processing portion 81 determines whether or not a front end of a conveyed sheet has passed the arrangement position P2 at which the registration roller 26 is arranged, and determines whether or not a rear end of the sheet has passed the arrangement position P2.

For example, the determination processing portion 81 determines whether or not the front end of the conveyed sheet has passed the arrangement position P2 and determines whether or not the rear end of the sheet has passed the arrangement position P2, based on the speed detected by the first speed detecting portion 27 and the detection result of the sheet detecting portion 29.

Specifically, when the electric signal S2 output from the sheet detecting portion 29 switches from a signal indicating absence of a sheet to a signal indicating presence of a sheet, and then the electric signal S1 is input from the first speed detecting portion 27 for the first time after the electric signal S2 switched to the signal indicating presence of a sheet, the determination processing portion 81 determines that the front end of the sheet has passed the arrangement position P2. In addition, when the electric signal S2 output from the sheet detecting portion 29 switches from the signal indicating presence of a sheet to the signal indicating absence of a sheet, the determination processing portion 81 determines that the rear end of the sheet has passed the arrangement position P2.

It is noted that the determination processing portion 81 may determine whether or not a front end of a conveyed sheet has passed the arrangement position P2 and determine whether or not a rear end of the sheet has passed the arrangement position P2 based on a time period that has elapsed since a detection of the front end or the rear end of the sheet by the optical sensor.

The determination processing portion 81 outputs an electric signal S3 (see FIG. 3) that indicates a determination result. The electric signal S3 output from the determination processing portion 81 is input to the switch control portion 86.

The storage portion 83 includes a plurality of predetermined first storage areas (an example of the storage area of the present disclosure) and a second storage area.

The measurement processing portion 82 measures the output cycle of the electric signal S4 input from the second speed detecting portion 57. Specifically, each time it measures one output cycle, the measurement processing portion 82 stores the output cycle in one of the first storage areas so that output cycles are stored in sequence in the first storage areas. In addition, when the output cycles are stored in all of the first storage areas, the measurement processing portion 82 overwrite new output cycles on the first storage areas in order from one in which the output cycle was stored at the earliest timing.

The calculation processing portion 84 calculates an average value of the output cycles stored in the first storage areas of the storage portion 83. Specifically, each time an output cycle is stored in a storage area of the storage portion 83 by the measurement processing portion 82, the calculation processing portion 84 calculates an average value of the output cycles stored in the storage areas. For example, the calculation processing portion 84 stores the calculation result in the second storage area.

The signal output portion 85 outputs an electric signal S5 (see FIG. 3). For example, the electric signal S5 is a pulse signal as is the case with the electric signal S1. The electric signal S5 output from the signal output portion 85 is input to the switch control portion 86.

For example, the signal output portion 85 outputs the electric signal S5 each time a specific time period elapses, the specific time period corresponding to the moving average of the output cycle stored in the second storage area of the storage portion 83. It is noted that the signal output portion 85 may output the electric signal S5 each time an output cycle stored in one of the first storage areas elapses. In this case, the second control portion 8 may not include the calculation processing portion 84.

When the determination processing portion 81 determines that the front end of the conveyed sheet has passed the arrangement position P2, the switch control portion 86 switches an output interval at which the detection signal S7 is output from the light receiving portion 282, to the first interval; and when the determination processing portion 81 determines that the rear end of the conveyed sheet has passed the arrangement position P2, the switch control portion 86 switches the output interval to the second interval.

Specifically, in the image forming apparatus 10, the light receiving portion 282 outputs the detection signal S7 in response to an input of a specific electric signal (an example of the predetermined electric signal of the present disclosure) which is the electric signal S1, the electric signal S5 or the like. In addition, when the determination processing portion 81 determines that the front end of the conveyed sheet has passed the arrangement position P2, the switch control portion 86 switches an output source of the specific electric signal that is input to the light receiving portion 282, from the signal output portion 85 to the first speed detecting portion 27. Furthermore, when the determination processing portion 81 determines that the rear end of the conveyed sheet has passed the arrangement position P2, the switch control portion 86 switches the output source of the specific electric signal that is input to the light receiving portion 282, from the first speed detecting portion 27 to the signal output portion 85.

For example, when the determination processing portion 81 determines that the front end of the conveyed sheet has passed the arrangement position P2, the switch control portion 86 switches the output source of the specific electric signal to the first speed detecting portion 27, and restricts the electric signal S1 that is output from the first speed detecting portion 27 for the first time after the switching, from being input to the light receiving portion 282.

In addition, after the determination processing portion 81 determines that the rear end of the conveyed sheet has passed the arrangement position P2, the switch control portion 86 switches the output source of the specific electric signal to the signal output portion 85 simultaneously when the electric signal S1 that is output from the first speed detecting portion 27 for the first time after the determination is input to the light receiving portion 282, and resets the time measured by the signal output portion 85. Specifically, the switch control portion 86 resets the time measured by the signal output portion 85, by inputting a reset signal S6 (see FIG. 3) to the signal output portion 85.

It is noted that the second control portion 8 may not include the measurement processing portion 82, the storage portion 83, the calculation processing portion 84, and the signal output portion 85. For example, the electric signal S4 output from the second speed detecting portion 57 may be directly input to the switch control portion 86.

Next, an operation of the second control portion 8 is described with reference to FIG. 4.

First, at time T1, a front end of a sheet reaches the arrangement position P2. This allows the electric signal S2 output from the sheet detecting portion 29 to switch from a signal (low) indicating absence of a sheet to a signal (high) indicating presence of a sheet.

Subsequently, at time T2, the rotational driving of the registration roller 26 is started, and the registration roller 26 transits from the stopped state to the accelerated state where the registration roller 26 is accelerated from the stopped state toward the first speed V1. This allows the first speed detecting portion 27 to output the electric signal S1 in a cycle corresponding to a reciprocal of the rotation speed of the registration roller 26. Upon an input of the electric signal S1, the determination processing portion 81 determines that the front end of the conveyed sheet has passed the arrangement position P2, and outputs the electric signal S3 indicating the determination result. Upon an input of the electric signal S3 indicating that the front end of the conveyed sheet has passed the arrangement position P2, the switch control portion 86 switches the output source of the specific electric signal that is input to the light receiving portion 282, from the signal output portion 85 to the first speed detecting portion 27. This allows the output interval at which the detection signal S7 is output from the image sensor 28, to be switched to the first interval that is cynchronized with the rotation speed of the registration roller 26. With this configuration, if the sheet conveyance speed of the registration roller 26 changes while the sheet is passing the detection position P1, it is possible to restrict reduction in the accuracy of detecting the shape of the sheet.

Here, the switch control portion 86 switches the output source of the specific electric signal to the first speed detecting portion 27, and restricts the electric signal S1 that is output from the first speed detecting portion 27 for the first time after the switching, from being input to the light receiving portion 282. This prevents the input interval between: the electric signal S3 that has been input from the signal output portion 85 to the light receiving portion 282 before the switching; and the electric signal S1 that is input from the first speed detecting portion 27 to the light receiving portion 282 after the switching, from becoming extremely short. Accordingly, it is possible to avoid an operation defect that would occur if the input interval in the image sensor 28 was extremely short.

Subsequently, at time T3, the rotation speed of the registration roller 26 reaches the first speed V1, and the registration roller 26 transits from the accelerated state to the first driven state.

Subsequently, at times T4 to T5, the rotation speed of the registration roller 26 is decelerated from the first speed V1 to the second speed V2, and the registration roller 26 transits from the first driven state to the second driven state.

Subsequently, at time T6, the rear end of the sheet passes the arrangement position P2. This allows the electric signal S2 output from the sheet detecting portion 29 to switch from the signal (high) indicating presence of a sheet to the signal (low) indicating absence of a sheet. When the electric signal S2 output from the sheet detecting portion 29 switches from the signal indicating presence of a sheet to the signal indicating absence of a sheet, the determination processing portion 81 determines that the rear end of the sheet has passed the arrangement position P2, and outputs the electric signal S3 indicating the determination result. Upon an input of the electric signal S3 indicating that the rear end of the sheet has passed the arrangement position P2, the switch control portion 86 switches the output source of the specific electric signal that is input to the light receiving portion 282, from the first speed detecting portion 27 to the signal output portion 85. This allows the output interval of the detection signal S7 output from the image sensor 28 is switched to the second interval. As a result, even after the registration roller 26 is stopped, it is possible to cause the image sensor 28 to output the detection signal S7.

Here, the switch control portion 86 switches the output source of the specific electric signal to the signal output portion 85 simultaneously when the electric signal S1 that is output from the first speed detecting portion 27 for the first time after the determination made by the determination processing portion 81 is input to the light receiving portion 282, and resets the time measured by the signal output portion 85. With this configuration where the time measured by the signal output portion 85 is reset at the timing when the output source of the specific electric signal is switched, the input interval between: the electric signal S1 that is input to the light receiving portion 282 before the switching; and the electric signal S5 that is input to the light receiving portion 282 after the switching, is prevented from becoming extremely short. Accordingly, it is possible to avoid an operation defect that would occur if the input interval in the image sensor 28 was extremely short. In addition, with this configuration where the output source of the specific electric signal is switched simultaneously when the electric signal S1 that is output from the first speed detecting portion 27 for the first time after the determination made by the determination processing portion 81 is input to the light receiving portion 282, and the time measured by the signal output portion 85 is reset, the input interval is prevented from being lengthened, compared to the input intervals before and after thereof.

In addition, the signal output portion 85 outputs the electric signal S5 each time the specific time period elapses, the specific time period corresponding to the moving average of the output cycle stored in the second storage area of the storage portion 83. This makes it possible to approximate the second interval to an interval that is synchronized with the rotation speed of the conveyance belt 51. As a result, compared to a configuration where the second interval is set to a fixed interval, it is possible to improve the accuracy of detecting the shape of the sheet during a period from when the rear end of the sheet passes the arrangement position P2 to when the rear end of the sheet passes the detection position P1.

Subsequently, at time T7, the rotation speed of the registration roller 26 is decelerated from the second speed V2 toward the stopped state, and the registration roller 26 transits from the second driven state to the decelerated state.

Subsequently, at time T8, the rotational driving of the registration roller 26 is stopped, and the registration roller 26 transits from the decelerated state to the stopped state. This causes the electric signal S1 to be stopped from being output from the first speed detecting portion 27.

As described above, in the image forming apparatus 10, when it is determined that the front end of the conveyed sheet has passed the arrangement position P2, the output interval at which the detection signal S7 is output from the image sensor 28 is switched to the first interval that corresponds to the speed detected by the first speed detecting portion 27. In addition, when it is determined that the rear end of the conveyed sheet has passed the arrangement position P2, the output interval is switched to the second interval that corresponds to the speed detected by the second speed detecting portion 57. This makes it possible to restrict reduction in the accuracy of detecting the shape of the sheet, and set, before the next sheet is conveyed, the reference value used to detect the shape of the sheet.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveyance device comprising:

a first conveyance member provided on an upstream side of an image forming position in a conveyance path along which a sheet is conveyed, the first conveyance member being rotationally driven in a driving cycle in which the first conveyance member enters a driven state where the first conveyance member is driven while decelerated in a stepped manner, and then the first conveyance member is decelerated to a stopped state;

a second conveyance member configured to convey the sheet at the image forming position by being rotationally driven to rotate at a specific speed that is a lowest speed in the driven state;

a shape detecting portion including a light emitting portion and a light receiving portion, the light emitting portion being configured to emit light toward a detection position located between the first conveyance member and the second conveyance member in the conveyance path, the light extending in a width direction of the sheet perpendicular to the conveyance path, the light receiving portion being configured to receive the light that has been emitted from the light emitting portion and reflected on the sheet passing the detection position, and output a detection signal corresponding to an amount of received light, the shape detecting portion being configured to detect a shape of the sheet based on the detection signal;

a first speed detecting portion configured to detect a rotation speed of the first conveyance member;

a second speed detecting portion configured to detect a rotation speed of the second conveyance member;

a determination processing portion configured to determine whether or not a front end of the sheet that is being conveyed has passed an arrangement position at which the first conveyance member is arranged, and determine whether or not a rear end of the sheet that is being conveyed has passed the arrangement position;

a switch control portion configured to, when the determination processing portion determines that the front end of the sheet has passed the arrangement position, switch an output interval at which the detection signal is output from the light receiving portion, to a first interval that corresponds to the rotation speed detected by the first speed detecting portion, and when the determination processing portion determines that the rear end of the sheet has passed the arrangement position, switch the output interval to a second interval that corresponds to the rotation speed detected by the second speed detecting portion.

2. The sheet conveyance device according to claim 1, further comprising:

a sheet detecting portion configured to detect whether or not the sheet is present at the arrangement position, wherein the determination processing portion determines whether or not the front end of the sheet has passed the arrangement position and determines whether or not the rear end of the sheet has passed the arrangement position, based on the rotation speed detected by the first speed detecting portion and a detection result of the sheet detecting portion.

3. The sheet conveyance device according to claim 2, wherein the light receiving portion outputs the detection signal in response to an input of a predetermined electric signal, the first speed detecting portion outputs the electric signal in a cycle corresponding to a reciprocal of a rotation speed of the first conveyance member, the second speed detecting portion outputs the electric signal in a cycle corresponding to a reciprocal of a rotation speed of the second conveyance member, the sheet conveyance device further comprises:

a measurement processing portion configured to measure an output cycle of the electric signal input from the second speed detecting portion;

a signal output portion configured to output the electric signal each time the output cycle measured by the measurement processing portion elapses, and when the determination processing portion determines that the front end of the sheet has passed the arrangement position, the switch control portion switches an output source of the electric signal that is input to the light receiving portion, to the first speed detecting portion, and when the determination processing portion determines that the rear end of the sheet has passed the arrangement position, the switch control portion switches the output source of the electric signal to the signal output portion.

4. The sheet conveyance device according to claim 3, wherein after the determination processing portion determines that the rear end of the sheet has passed the arrangement position, the switch control portion switches the output source of the electric signal to the signal output portion simultaneously when the electric signal that is output from the first speed detecting portion for a first time after the determination processing portion determines that the rear end of the sheet has passed the arrangement position is input to the light receiving portion, and resets a time measured by the signal output portion.

5. The sheet conveyance device according to claim 2, wherein the light receiving portion outputs the detection signal in response to an input of a predetermined electric signal, the first speed detecting portion outputs the electric signal in a cycle corresponding to a reciprocal of a rotation speed of the first conveyance member, the second speed detecting portion outputs the electric signal in a cycle corresponding to a reciprocal of a rotation speed of the second conveyance member, the sheet conveyance device further comprises:

a storage portion having a plurality of storage areas;

a measurement processing portion configured to measure an output cycle of the electric signal input from the second speed detecting portion, and each time it measures one output cycle, the measurement processing portion stores the output cycle in one of the storage areas so that output cycles are stored in sequence in the storage areas;

a signal output portion configured to output the electric signal each time a specific period corresponding to a moving average of the output cycle stored in each of the storage areas elapses, and when the determination processing portion determines that the front end of the sheet has passed the arrangement position, the switch control portion switches an output source of the electric signal that is input to the light receiving portion, to the first speed detecting portion, and when the determination processing portion determines that the rear end of the sheet has passed the arrangement position, the switch control portion switches the output source of the electric signal to the signal output portion.

6. The sheet conveyance device according to claim 3, further comprising:

when the determination processing portion determines that the front end of the sheet has passed the arrangement position, the switch control portion switches the output source of the electric signal to the first speed detecting portion, and restricts the electric signal that is output from the first speed detecting portion for a first time after the switch control portion switches the output source to the first speed detecting portion, from being input to the light receiving portion.

7. The sheet conveyance device according to claim 1, further comprising:

a setting processing portion configured to set a reference value that is used by the shape detecting portion to detect the shape of the sheet, based on the detection signal output from the light receiving portion while the first conveyance member is in the stopped state, wherein the shape detecting portion detects the shape of the sheet by using the reference value set by the setting processing portion.

8. An image forming apparatus comprising:

the sheet conveyance device according to claim 1; and an image forming portion configured to form an image on a sheet at the image forming position.

9. The image forming apparatus according to claim 8, further comprising:

a restriction processing portion configured to restrict the image forming portion from forming an image beyond the sheet, based on the shape of the sheet detected by the shape detecting portion.

10. The image forming apparatus according to claim 8, wherein the image forming portion forms the image on the sheet by an inkjet system.

11. A sheet shape detecting method executed on a sheet conveyance device which includes a first conveyance member, a second conveyance member, a shape detecting portion, a first speed detecting portion, and a second speed detecting portion, the first conveyance member being provided on an upstream side of an image forming position in a conveyance path along which a sheet is conveyed, the first conveyance member being rotationally driven in a driving cycle in which the first conveyance member enters a driven state where the first conveyance member is driven while decelerated in a stepped manner, and then the first conveyance member is decelerated to a stopped state, the second conveyance member being configured to convey the sheet at the image forming position by being rotationally driven to rotate at a specific speed that is a lowest speed in the driven state, the shape detecting portion including a light emitting portion and a light receiving portion, the light emitting portion being configured to emit light toward a detection position located between the first conveyance member and the second conveyance member in the conveyance path, the light extending in a width direction of the sheet perpendicular to the conveyance path, the light receiving portion being configured to receive the light that has been emitted from the light emitting portion and reflected on the sheet passing the detection position, and output a detection signal corresponding to an amount of received light, the shape detecting portion being configured to detect a shape of the sheet based on the detection signal, the first speed detecting portion being configured to detect a rotation speed of the first conveyance member, the second speed detecting portion being configured to detect a rotation speed of the second conveyance member, the sheet shape detecting method comprising:

determining whether or not a front end of the sheet that is being conveyed has passed an arrangement position at which the first conveyance member is arranged, and determining whether or not a rear end of the sheet that is being conveyed has passed the arrangement position; and when it is determined that the front end of the sheet has passed the arrangement position, switching an output interval at which the detection signal is output from the light receiving portion, to a first interval that corresponds to the rotation speed detected by the first speed detecting portion, and when it is determined that the rear end of the sheet has passed the arrangement position, switching the output interval to a second interval that corresponds to the rotation speed detected by the second speed detecting portion.

* * * * *